United States Patent [19]

McIntosh

[11] Patent Number: 4,535,715

[45] Date of Patent: Aug. 20, 1985

[54] AIR VENT

[76] Inventor: Ian A. McIntosh, ¾ Muston St., Mosman, N. SW., Australia, 2088

[21] Appl. No.: 569,625

[22] PCT Filed: Apr. 19, 1983

[86] PCT No.: PCT/AU83/00046

§ 371 Date: Jan. 10, 1984

§ 102(e) Date: Jan. 10, 1984

[87] PCT Pub. No.: WO83/04010

PCT Pub. Date: Nov. 24, 1983

[30] Foreign Application Priority Data

May 11, 1982 [AU] Australia ..... PF3949

[51] Int. Cl.[3] ..... B63J 2/00

[52] U.S. Cl. ..... 114/211; 114/212; 137/434

[58] Field of Search ..... 114/212, 211; 220/205, 220/203, 208; 137/409, 430, 433, 434

[56] References Cited

U.S. PATENT DOCUMENTS

| | | | |
|---|---|---|---|
| 1,389,104 | 8/1921 | Sayre | 114/212 |
| 1,851,084 | 3/1932 | Brown | 114/212 |
| 3,858,603 | 1/1975 | Lenz | 114/212 |
| 4,241,645 | 12/1980 | Le Compte | 114/211 |
| 4,307,655 | 12/1981 | Parks | 114/211 |

FOREIGN PATENT DOCUMENTS

| | | | |
|---|---|---|---|
| 253696 | 6/1926 | United Kingdom | 114/212 |

*Primary Examiner*—Trygve M. Blix
*Assistant Examiner*—C. T. Bartz
*Attorney, Agent, or Firm*—McDermott, Will & Emery

[57] ABSTRACT

A deck ventilator suitable for small vessels is formed as a low dome 12. Outside air may enter it through window 14 and then circulate around member 30, through orifice 22 and down duct 7 which pierces deck 4. Member 30 usually serves merely as a shield against spray, however if a surge of water enters compartment 18 the orifice 22 is closed by movement of member 30 which is slidably hinged to U-shaped rods 23. This closing movement results from the combination of the impact of the water on member 30 and the member's inherent buoyancy.

9 Claims, 6 Drawing Figures

AIR VENT

TECHNICAL FIELD

This invention relates to a ventilator and is more specifically concerned with a deck ventilator for marine use.

BACKGROUND ART

A deck ventilator for marine use is designed to keep a compartment within a ship ventilated while preventing water from flowing into the compartment should the head of this ventilator be flooded.

Deck ventilators fall into two categories. The first category of ventilator is for use on large ships such as tankers. It comprises a tall tubular pillar mounted on the deck and carrying at its upper end, which may be many feet above deck level, a large casing containing a valve which closes automatically if a wave washes over the casing. The valve is invariably provided with a buoyant closure, such as a hollow steel ball, which is bodily displaced upwardly against a valve seat if a wave washes over the casing. As soon as the casing is again exposed, the closure drops under its own weight to a rest position to allow air to pass into and out of the compartment.

Deck ventilators of the first category are described and illustrated in U.K. Patent No. 253,696, U.S. Pat. No. 1851084 and Swedish Patent No. 7315433-8. The casing has to be large enough to accommodate a relatively large closure, as the closure must be sufficiently buoyant to exert enough thrust on the valve seat to close the ventilation. The closure must also be sufficiently heavy to cause such closure to drop vertically from its closed position a sufficient distance to allow the ventilator to be unobstructed by the closure when open. Thus it will be recognized that the first category of ventilator is a large structure and is therefore not suitable for a pleasure vessel such as a sailing yacht or motor boat.

A second category of ventilator has therefore been developed for pleasure vessels and examples of it are shown and described in British Patent No. 1502386 and P.C.T. Specification WO 82/00336. The requirements of a deck ventilator on a pleasure vessel are that it shall be unobstructive so that the external appearance of the vessel is always clean, and that it shall be sufficiently low and robust to be trodden upon and not to interfere with a proper working of a ship.

To meet the above requirements the ventilator must be squat and should have a smooth external surface. It must still be capable, however, of adequately ventilating a compartment in the vessel. The second category of ventilator is not therefore regarded as being large enough to incorporate the free-floating buoyant closure member of the first category. Instead, the ventilator is either fully open with a manual closure used to shut it in rough weather or is provided with a baffle to impede the flow of water into the ventilator and which does not severely obstruct the passage of air into and out of the ventilator. Such a baffle is shown in the British Patent. The P.C.T. specification suggests a closure which closes automatically by the weight of water entering the compartment being ventilated. While this arrangement would reduce the back flow of water though the ventilator, it does not prevent it altogether, it is dubious whether it would be regarded as a solution to the problem of how to ventilate a compartment of a pleasure vessel in a way which allows effective operation when the ventilator is open, and automatic and effective closure of the ventilator when submerged in a wave.

An object of the invention is to provide a deck ventilator for a pleasure vessel which closes automatically when under water.

DISCLOSURE OF INVENTION

A deck ventilator for a pleasure vessel is housed within a squat shallow dome internally divided into two chambers. A ventilator duct projecting down from one of the chambers in the dome extends through the deck into the vessel while the other chamber opens to atmosphere through a window in the dome. The two chambers are separated by a common wall formed with an orifice which has an associated closure member pivotally movable between its open position, to which it is normally biased, and a second position at which it closes the orifice. The movement of the member between its two positions is controlled by a float responsive to liquid washing into the second chamber via the window. The use of a pivoting movement enables the closure member to act as a lever under the thrust of the float. Thus the closure moves to a predetermined sealing position when the ventilator closes. This enables the closing surfaces bounding the orifice and the closure to be made to seal against one another. It also allows effective closure of the ventilator in the absence of sufficient vertical space to accommodate a free floating and vertically displaceable buoyant member.

The float may be built into the closure and preferably is formed with a sloping surface against which an upward thrust is applied by a surge of water entering the window in the dome. Conveniently the pivoting movement is provided by a slidable hinge, which is located above the window. The common wall preferably slopes diagonally down from above the position of the hinge to almost deck level at the opposite side of the dome. The advantage of such an arrangement is that condensation inside the dome and any water which leaks through the orifice, runs down the sloping common wall to its lower end and which is provided with "weep" holes. The water can flow out through these holes within the dome and pass out the end of the dome via a narrow gap between the under edge of the dome and the deck of the vessel. Suitably a curved baffle is also provided around the upper end position of the ventilator duct where it projects into the first compartment.

The invention will now be described in more detail, by way of example with reference to the accompanying drawings, in which:

MODES OF CARRYING OUT THE INVENTION

Figure 1:
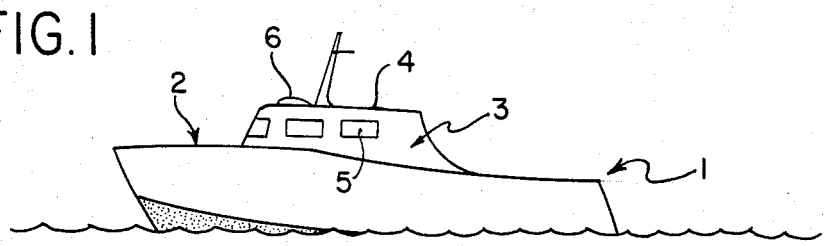
FIG. 1 is a motor pleasure vessel fitted at the forward upper end of its saloon with a ventilator of the invention.

FIG. 1 shows a motor boat with a deck 2. The boat has a saloon compartment 3 with a deckhead 4 provided with windows 5. At the foreward end of the deckhead 4 is a ventilator 6.

Figure 2:
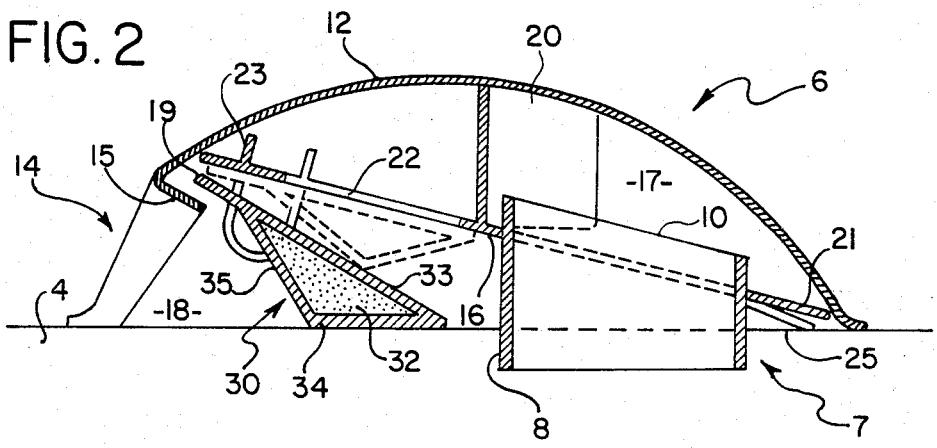
FIG. 2 is vertical section through the centre of the ventilator in the direction of the fore-and-aft line of the ship.

Turning to FIG. 2, the ventilator 6 is provided with a duct 7 which projects at its lower end 8 through the deckhead 4. The duct 7 has its upper edge 10 cut obliquely.

Figure 3:
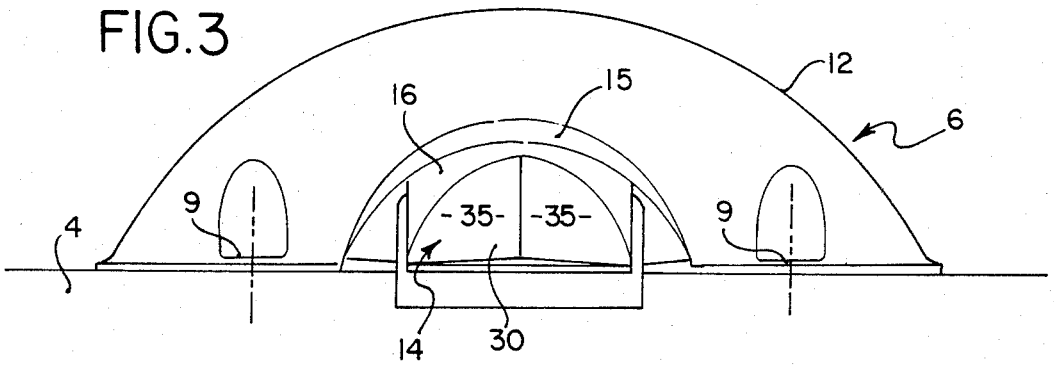
FIG. 3 is a front vertical elevation of the ventilator viewed from ahead of the vessel.

The ventilator 6 comprises a domed cap 12 having a window 14 formed in its forward end as shown in FIG. 3, and framed by a margin 15. Bolt holes 9 allow the cap 12 to be secured to the deck by bolts, not shown.

The interior of the cap 12 is divided by a sloping common wall 16 into first and second chambers 17, 18 respectively. The upper end portion of the duct 7 opens into the first chamber 17 and the window 14 opens into the second chamber 18. An arched baffle 20 is arranged concentrically around and spaced from the forward side of the duct 7 as shown in broken outline in FIG. 4.

A weep hole 21 is provided in the lower end of the wall 16 above a flap valve 25 which allows any water which may have penetrated the first compartment from the second to drain off, via the weep hole 21. There is, in practice, a small gap between the deck 4 and the under rim of the cap 12.

The common wall 16 is provided towards its upper end with an orifice 22 of the same cross sectional area as the duct 7. Two hinges clips 23 provided by U-shaped rods are secured at the ends of the limbs of the U in respective holes in the wall 16. A closure member 30 is formed towards its upper end with spaced holes 24 through which the clips 23 are a respective slack fit. This gives the hinge a "sliding hinge" characteristic, that is to say the closure member 30 can displace bodily vertically during closing as well as turn about the hinge axis. When viewed in vertical section, the member 30 is seen as shown in FIG. 2, to have a sealed, hollow, generally triangular shaped interior, except for its upper marginal end 19 which extends into the space between the re-entrant margin 15 of the cap and the wall 16. Buoyant material 32 such as foam polystyrene may be used to fill the triangular interior of the member 30. The closure member 30 has an upper flat face 33 shaped to seat around the edge of the orifice 22 when the member 30 moves upwardly to its closed position, shown in broken outline in FIG. 2.

A second flat surface 34 to the closure for member 30 rests on the deck 4 when the valve is open as shown. The converging flank surfaces 35 of the member 30 slope down behind the window 14 so that a surge of water entering the window strikes against the surfaces 35 which deflect it sideways and simultaneously urges the member 30 upwardly. This force on the member 34 is additional to that provided by its buoyance. This helps to close the ventilator quickly.

Under normal conditions the ventilator is open and provides an unobstructed flow path leading from the window 14 to the duct 7. The cross-section of the opening provided between the common wall and the member 30 is preferably less than that of the duct despite the tortuous and branched nature of the flow path. The member 30 prevents spray being blown through the window 14 into the orifice 22.

Should a wave wash over the ventilator a surge of water will enter the ventilator through the window 14. This is deflected laterally by the flank surfaces 35 of the closure 30 and exerts an upward force on it. Simultaneously the buoyancy of the member 30 causes it to lift, and the combination of these two effects combined with the shape of the member 30 and the sliding hinge causes it to shut the orifice 22 quickly before the water level in the second chamber has risen to the level of the orifice 22. When the wave has passed, the ventilator empties via the window 14 and the narrow gap between the rim of the domed cap and the deck 4.

Inevitably a small amount of water will enter the first chamber in some condition. This may occur from leakage through the closed orifice 22, from condensation forming inside the cap of the ventilator if moist warm air is drawn up the duct 7, or from water spurting in through the weep hole 21. Such water flows down the inside surface of the cap 12 and the wall 16 to the weep hole 21 which allows it to escape. The baffle 20 deflects water flowing down the parti-wall 16 from entering the duct 7.

Figure 4:
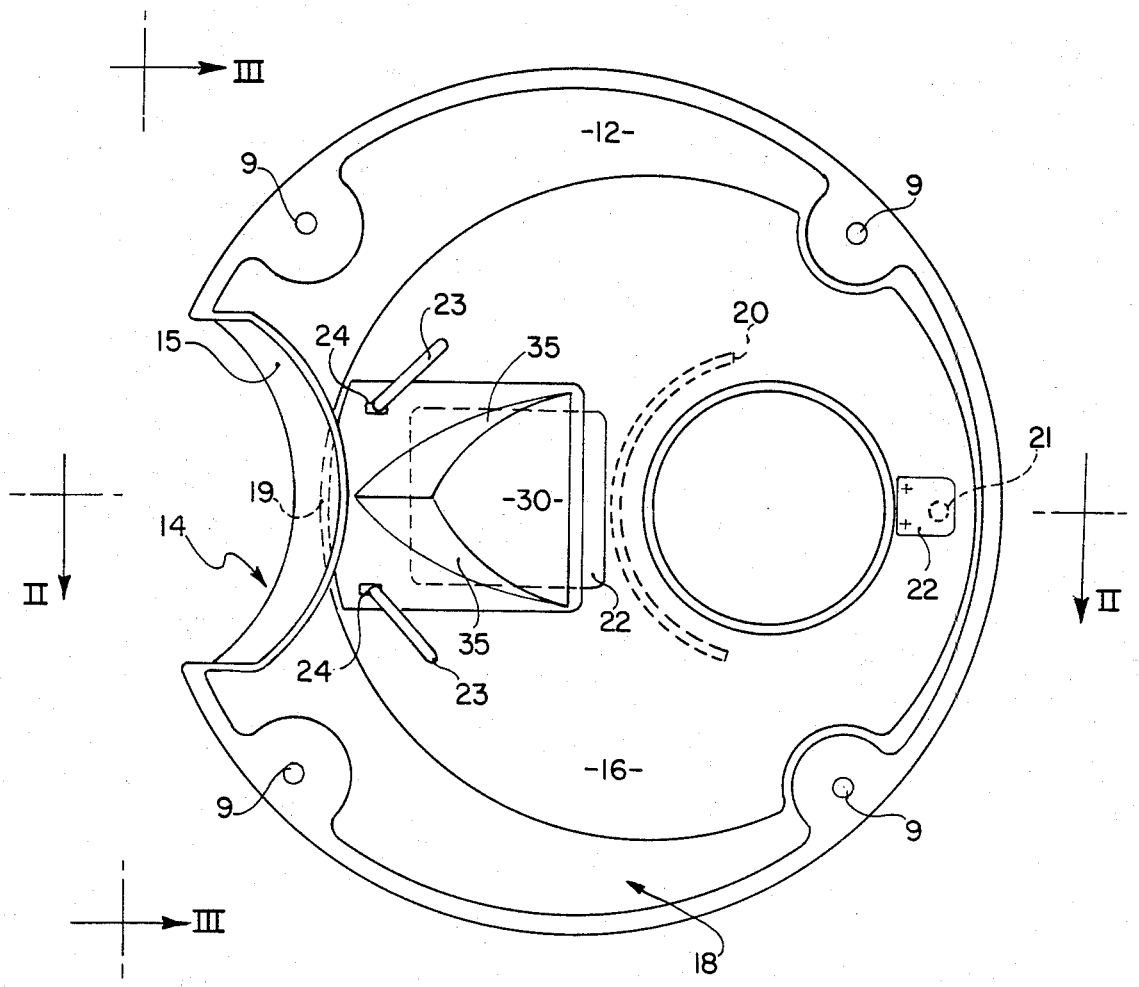
FIG. 4 is an under-plan view of the ventilator.
Figure 6:
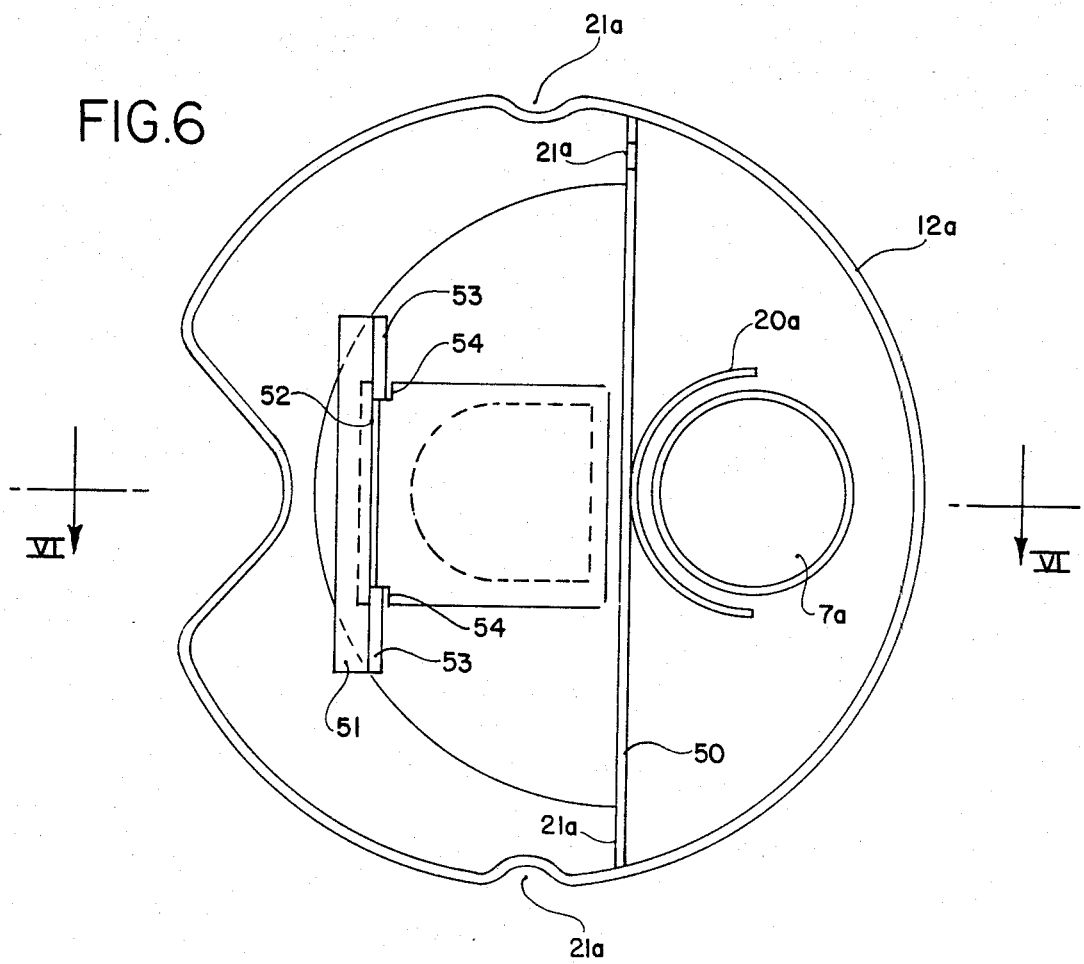
FIG. 6 is a second view of the modified ventilator, corresponding to that shown in FIG. 4.
Figure 5:
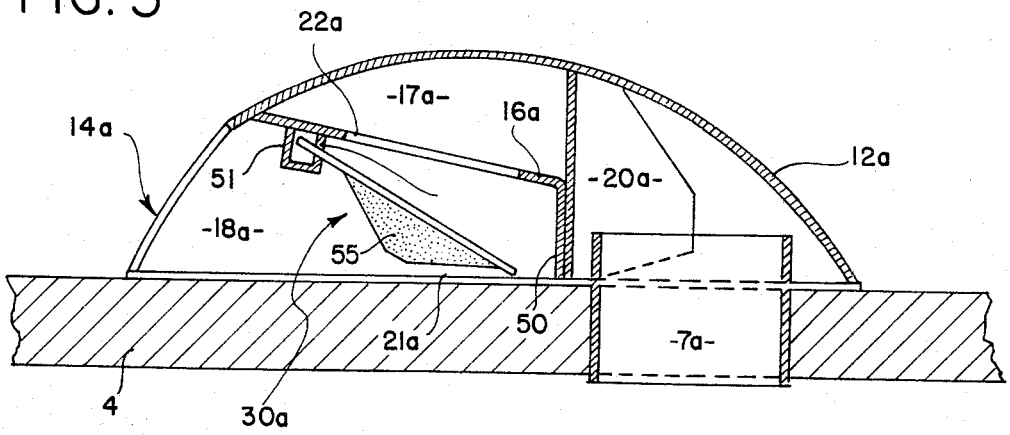
FIG. 5 shows a modified construction of ventilator and in a view corresponding to FIG. 2.

FIGS. 5 and 6 show a second form of ventilator embodying the invention and which correspond to FIGS. 4 and 2 respectively, in the views that they show. Parts of FIGS. 5 and 6 which correspond to parts of FIGS. 4 and 2 bear the same reference numerals followed by an a.

The ventilator of FIGS. 5 and 6 is provided with a duct 7*a*. The two chambers 17*a*, 18*a* are separated by a common-wall 16*a* formed with stop to provide a vertical portion 50. The baffle 20*a* is spot welded to the vertical portion to deflect water, running down the downwardly sloping part of the common-wall 16*a*, around the top of the duct 7*a* into the lower portion of the first chamber 17*a*. The under rim of the domed cap 12*a* is spaced by a narrow gap from the surface of the deck to allow water to escape from the first chamber 17*a*. The closure member 30 is hinged slackly to the underside of the common-wall by a channel 51 so as to provide a sliding hinge. The channel has a slot 52 formed in the lower of its two parallel sides and extending between the side-wall portions 53. At the sides of its upper marginal end the member 30 is provided with opposed notches 54 within which the side-wall portions 53 locate, as shown in FIG. 6 to provide the slack hinge giving the vertical sliding effect as the closure moves towards its closed position.

The underside of the member 30 may be provided with a block 55 of buoyant material of triangular vertical section.

Weep holes 21*a* extend through the lower sides of the vertical portion 50 and through the underside of the cap 12*a* at the position of the second chamber 18. The modified ventilator of FIGS. 5 and 6 operates in the same way as the ventilator shown in FIGS. 2 to 4. It is slightly more expensive to manufacture but has the advantage that it can be used when the duct 7*a* is square cut at its upper end and extends only a limited extent above the surface of the deckhead 4.

I claim:

1. A deck ventilator comprising a squat cap having a side wall formed with a window next to the deck; a common-wall formed with an orifice and dividing the cap interior into two chambers one of which communicates with the window; a ventilator duct in the other chamber and having its lower end portion projecting downwardly through the deck; hinge means in said one chamber; a closure member turnable about the hinge means from a first position at which the orifice is unobstructed and to which the member is biased, to a second position at which the member closes the orifice and a buoyant element effectively integral with the member and which biases it to the second position when the closure member is impacted upon by a horizontally directed surge of water running along the deck and entering said one chamber by way of the sideways facing window.

2. The ventilator claimed in claim 1, in which the orifice is provided in an upwardly sloping portion of the common-wall, the hinge is located above the window and the orifice, and the member screens the orifice from the window when in the first position.

3. The ventilator claimed in claim 2, in which the buoyant element comprises a block fixed to the underside of the member and provided with side surfaces which converge towards the window and are shaped to deflect water surging in through the window downwardly and away from the orifice while simultaneously exerting an upward force on the member.

4. The ventilator claimed in claim 3, in which the common-wall comprises an upwardly-sloping flat plate through which the duct end-portion extends and which defines with its under surface the roof of said one chamber, and with its top surface the floor of the other chamber.

5. The ventilator claimed in claim 4, in which a weep hole is formed through the lower margin of the common-wall at a position protected from water entering the window.

6. The ventilator claimed in claim 5, in which the cap is domed and has an entrant margin above the window directing an incoming surge of water towards the buoyant element.

7. A deck ventilator comprising a squat domed cap, a side-wall to said cap defining a sideways facing window disposed next to the deck; a flat plate formed with an orifice and providing a common-wall dividing the cap interior into two chambers one of which communicates with the window; a duct extending downwardly through the deck to a compartment to be ventilated; an upper-end portion of the duct projecting into the other chamber; a closure member in said one chamber and for closing said orifice a sliding hinge connection formed between the upper portion of the closure member and the underside of the common-wall at a position between the orifice and a margin of the cap above the window, the hinge connection defining a horizontal hinge axis for the closure which slopes down from said axis away from the window and which has a width sufficient to screen the orifice from the window; buoyant means on the underside of said closure to urge it upwardly to close the orifice if impacted upon by a horizontally directed surge of water entering the cap by way of said window, and weep holes for draining water out of said other chamber.

8. A deck ventilator as claimed in claim 7, in which the sliding hinge is provided by rods projecting from the under side of the common-wall and passing slackly through holes in the closure, the cap margin above the window is of re-entrant shape and slopes downwards to deflect water surging through the window towards said buoyant means, and an upper marginal end of the closure member extends into the gap between the common-wall and the re-entrant cap margin to shield the upper end of the orifice and the sliding hinge from water surging into the cap.

9. A deck ventilator as claimed in claim 8, in which a positionally-fixed baffle is arranged between the upper end-portion of the duct and the orifice to deflect any water which leaks through the closed orifice away from the duct.

* * * * *